US008602594B2

(12) United States Patent
Jeon et al.

(10) Patent No.: US 8,602,594 B2
(45) Date of Patent: Dec. 10, 2013

(54) LIGHTING DEVICE

(75) Inventors: Yongseog Jeon, Seoul (KR); Yongjin Kim, Seoul (KR); Jeongsoo Lee, Seoul (KR); Youngjae Cho, Seoul (KR); Moonsung Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 198 days.

(21) Appl. No.: 13/081,023

(22) Filed: Apr. 6, 2011

(65) Prior Publication Data

US 2011/0317420 A1 Dec. 29, 2011

(30) Foreign Application Priority Data

Jun. 23, 2010 (KR) ..... 10-2010-0059560

(51) Int. Cl.
*F21S 4/00* (2006.01)
*F21V 29/00* (2006.01)

(52) U.S. Cl.
USPC ..... 362/249.02; 362/294; 362/373

(58) Field of Classification Search
USPC ..... 362/249.02, 294, 373
See application file for complete search history.

(56) References Cited

U.S. PATENT DOCUMENTS

| | | | | |
|---|---|---|---|---|
| 1,456,585 | A | 5/1923 | Bell | |
| 4,207,607 | A | 6/1980 | Gulliksen | |
| 5,722,760 | A | 3/1998 | Chien | |
| 5,940,269 | A | 8/1999 | Ko et al. | |
| 6,331,063 | B1 | 12/2001 | Kamada et al. | |
| 6,367,949 | B1 | 4/2002 | Pederson | |
| 6,461,024 | B1 | 10/2002 | Becker et al. | |
| 6,599,002 | B2 | 7/2003 | Hsieh et al. | |
| 7,134,769 | B2 | 11/2006 | Rohlfing et al. | |
| 7,322,718 | B2 | 1/2008 | Setomoto et al. | |
| 7,404,658 | B1 | 7/2008 | Lyons et al. | |
| 7,614,769 | B2 | 11/2009 | Sell | |
| 7,628,513 | B2 | 12/2009 | Chiu | |
| 7,686,486 | B2 | 3/2010 | Tessnow et al. | |
| 7,780,317 | B2 | 8/2010 | Schroll et al. | |
| 7,821,380 | B1 | 10/2010 | Grote, Jr. | |
| 7,988,335 | B2 * | 8/2011 | Liu et al. | 362/294 |
| 8,042,969 | B2 | 10/2011 | Paik et al. | |

(Continued)

FOREIGN PATENT DOCUMENTS

| | | |
|---|---|---|
| JP | 2004-179048 | 6/2004 |
| JP | 2006-48165 | 2/2006 |

(Continued)

OTHER PUBLICATIONS

Office Action dated Oct. 27, 2011 for U.S. Appl. No. 13/099,890.

(Continued)

*Primary Examiner* — Stephen F Husar
*Assistant Examiner* — James Cranson, Jr.
(74) *Attorney, Agent, or Firm* — KED & Associates LLP

(57) ABSTRACT

A lighting device may be provided that includes a light member having a light emitting diode (LED) to emit light in a first direction along a first axis, and a housing having a base to support the light member, and having a plurality of cooling fins that extend in a second direction away from the base. A plurality of holes may provide an air flow. Each hole may be provided through the housing from a first side of the base to the second side of the base. Each hole may correspond to an area between two separate ones of the cooling fins.

14 Claims, 6 Drawing Sheets

(56) References Cited

U.S. PATENT DOCUMENTS

| | | | | |
|---|---|---|---|---|
| 8,052,301 | B2 | 11/2011 | Zhou et al. | |
| 8,087,807 | B2 | 1/2012 | Liu et al. | |
| 8,206,015 | B2 | 6/2012 | Cho et al. | |
| 2002/0024822 | A1 | 2/2002 | Pond et al. | |
| 2004/0066142 | A1 | 4/2004 | Stimac | |
| 2005/0128752 | A1 | 6/2005 | Ewington | |
| 2006/0044806 | A1 | 3/2006 | Abramov et al. | |
| 2006/0092641 | A1 | 5/2006 | Phelan et al. | |
| 2008/0078524 | A1 | 4/2008 | Wilcox et al. | |
| 2008/0080162 | A1 | 4/2008 | Wilcox et al. | |
| 2008/0123331 | A1 | 5/2008 | Schroll et al. | |
| 2009/0003009 | A1 | 1/2009 | Tessnow et al. | |
| 2009/0129102 | A1 | 5/2009 | Xiao et al. | |
| 2009/0141508 | A1 | 6/2009 | Peng et al. | |
| 2009/0184619 | A1 | 7/2009 | Lai | |
| 2009/0290352 | A1 | 11/2009 | Wu et al. | |
| 2010/0214788 | A1 | 8/2010 | Kadono et al. | |
| 2011/0063832 | A1 | 3/2011 | Hu et al. | |
| 2011/0110046 | A1* | 5/2011 | Itoh et al. | 361/709 |
| 2011/0181167 | A1 | 7/2011 | Cho et al. | |
| 2011/0194282 | A1 | 8/2011 | Paik et al. | |
| 2011/0317412 | A1 | 12/2011 | Paik et al. | |
| 2011/0317428 | A1 | 12/2011 | Paik et al. | |
| 2012/0001531 | A1 | 1/2012 | Cho et al. | |
| 2012/0002424 | A1 | 1/2012 | Cho et al. | |
| 2012/0026740 | A1 | 2/2012 | Kim et al. | |
| 2012/0033423 | A1 | 2/2012 | Kim et al. | |
| 2012/0074835 | A1 | 3/2012 | Piquette et al. | |
| 2012/0106152 | A1 | 5/2012 | Zheng et al. | |
| 2012/0106167 | A1 | 5/2012 | Chang | |
| 2012/0120667 | A1 | 5/2012 | Schenkl | |
| 2012/0176801 | A1 | 7/2012 | You | |

FOREIGN PATENT DOCUMENTS

| | | |
|---|---|---|
| JP | 2009-048994 | 3/2009 |
| KR | 20-0353040 | 6/2004 |
| KR | 10-2006-0086177 | 7/2006 |
| KR | 10-2006-0104501 | 10/2006 |
| KR | 10-0695542 | 3/2007 |
| KR | 10-2007-0044022 | 4/2007 |
| KR | 10-0715039 | 5/2007 |
| KR | 2008-0020614 | 3/2008 |
| KR | 20-2008-0002564 | 7/2008 |
| KR | 10-2008-0093284 | 10/2008 |
| KR | 10-2009-0004569 | 1/2009 |
| KR | 10-2009-0042679 | 4/2009 |
| KR | 10-0896381 | 4/2009 |
| KR | 20-2009-0004396 | 5/2009 |
| KR | 2009-0097055 | 9/2009 |
| KR | 20-0447377 | 1/2010 |
| KR | 10-2010-0026422 | 3/2010 |
| KR | 10-2010-0030683 | 3/2010 |
| KR | 10-2010-0035934 | 4/2010 |
| KR | 10-2010-0055320 | 5/2010 |
| KR | 10-2010-006685 | 6/2010 |
| KR | 10-2010-0064800 | 6/2010 |
| KR | 10-2010-0066685 | 6/2010 |
| KR | 10-0967946 | 7/2010 |
| KR | 10-2011-0029915 | 3/2011 |
| WO | WO 2009/065389 | 5/2009 |

OTHER PUBLICATIONS

Notice of Allowance dated Feb. 21, 2012 for U.S. Appl. No. 13/099,890.

Office Action for U.S. Appl. No. 13/040,608 dated Sep. 13, 2012.

Office Action for U.S. Appl. No. 13/016,310 dated Sep. 18, 2012.

European Search Report for Application 11159284.6 dated Sep. 12, 2012.

Office Action dated Mar. 22, 2012 for U.S. Appl. No. 13/016,310.

Korean Prior Art Search Report for Application 10-2010-0062951 dated Mar. 31, 2011.

Korean Office Action for Application 10-2010-0062951 dated Apr. 22, 2011.

Korean Office Action for Application 10-2010-0059559 dated Apr. 15, 2011.

Korean Prior Art Search Report for Application 10-2010-0059559 dated Mar. 30, 2011.

Korean Prior Art Search Report for Application 10-2010-0063728 dated Mar. 31, 2011.

Korean Notice of Allowance for Application 10-2010-0059559 dated Jul. 11, 2011.

Korean Notice of Allowance for Application 10-2010-0062951 dated Jul. 28, 2011.

U.S. Office Action dated Feb. 14, 2013 for U.S. Appl. No. 13/040,608.

U.S. Office Action for U.S. Appl. No. 13/040,608 dated Jun. 4, 2013.

U.S. Office Action for U.S. Appl. No. 13/016,310 dated Aug. 14, 2013.

* cited by examiner

LIGHTING DEVICE

CROSS-REFERENCE TO RELATED APPLICATION

This application claims priority from Korean Patent Application No. 10-2010-0059560, filed Jun. 23, 2010, the subject matter of which is incorporated herein by reference.

BACKGROUND

1. Field

Embodiments of the present invention may relate to a lighting device.

2. Background

An electric lighting device may include a light source to emit light upon application of electricity thereto. The light source may emit heat as well as light.

Lighting devices using light emitting diodes (LEDs) are becoming more popular. These LED lighting devices may exhibit low power consumption.

Heat generated by the LEDs may exert a negative influence on a lifespan of the LEDs. Therefore, the LED lighting device may include a heat sink (or housing). The heat sink may be made of aluminum.

A module type lighting device may include a plurality of light modules. The module type lighting device may illuminate a relatively wider space.

BRIEF DESCRIPTION OF THE DRAWINGS

Arrangements and embodiments may be described in detail with reference to the following drawings in which like reference numerals refer to like elements and wherein.

DETAILED DESCRIPTION

Figure 1:
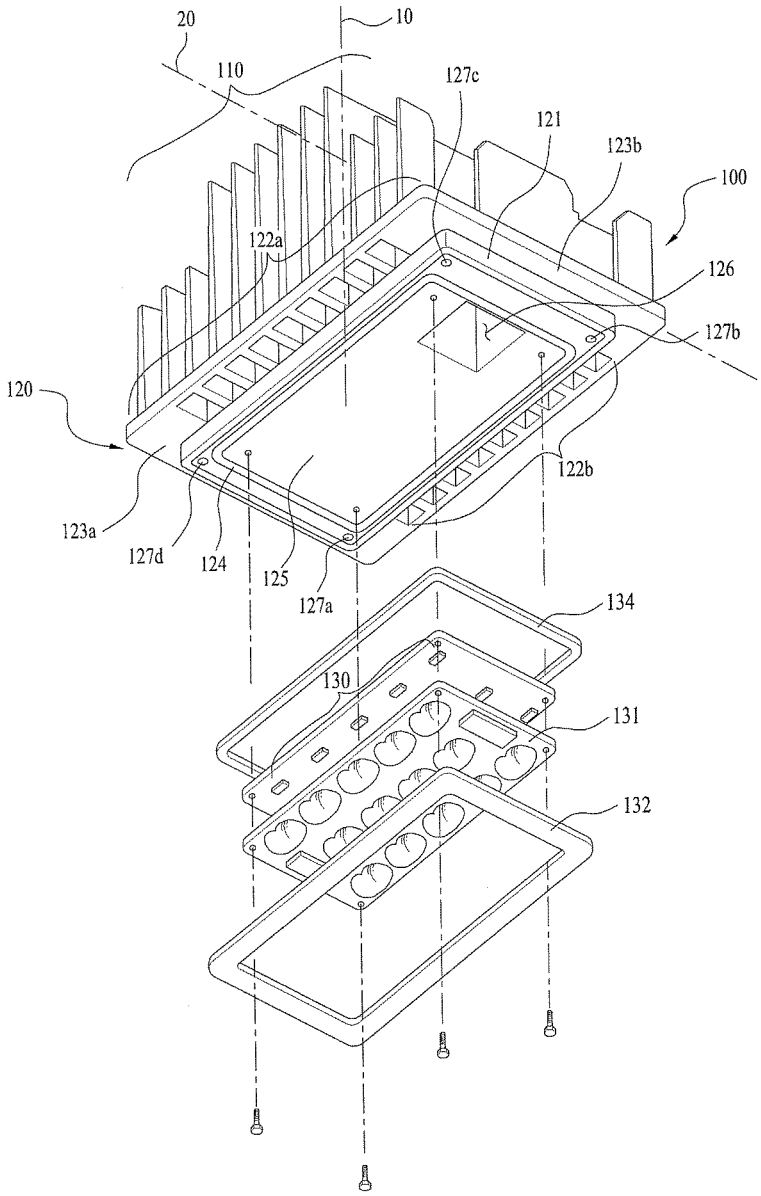
FIG. 1 is an exploded view of a lighting device in accordance with an example embodiment.

FIG. 1 shows a lighting device in accordance with an example embodiment. Other embodiments and configurations may also be provided.

A housing 100 may include a base 120 and a plurality of cooling fins 110. The base 120 and the plurality of cooling fins 110 may be formed as one integral part. The cooling fins 110 may extend from an upper surface (or side) of the base 120. The cooling fins 110 may be aligned in a first direction.

On the other side of the base 120, a light source 130 (or light member), a window 131, a cover 132 and a sealer 134 may be provided.

Air may flow through open spaces between the cooling fins 110. The open spaces between the cooling fins 110 may establish horizontal air passages and vertical air passages. The horizontal air passages may be in a direction along axis 20 that it may be considered substantially parallel to the base 120. The vertical air passages may be in a direction along axis 10 that may be considered substantially perpendicular to the base 120.

A plurality of holes 122*a* and 122*b* may be formed through the base 120 to extend (in the vertical direction) from a first side (or surface) of the base 120 to a second side of the base 120 (or surface). The holes 122*a* and 122*b* may be aligned with open spaces between the cooling fins 110. A space over the base 120 may be in flow communication with a space under the base 120 based on the holes 122*a* and 122*b*. Therefore, air may flow vertically via the holes 122*a* and 122*b*. The holes 122*a* and 122*b* may have approximately rectangular cross sections and closed side surfaces. However, the shape of the holes 122*a* and 122*b* is not limited thereto.

In another embodiment, side surfaces of the holes 122*a* and 122*b* may be open. For example, the holes 122*a* and 122*b* in an opened shape may be formed by removing, by cutting, one surface of each of the holes 122 of FIG. 1, adjacent to an edge of the base 120. In this example, the holes 122*a* and 122*b* may have a C-shaped cross section.

A vertical wall 121 may vertically protrude inside of edges of the base 120. The light source 130 (or light member) may be provided in a space that is surrounded by the vertical wall 121. The light source 130 (or light member) may include a plurality of LEDs mounted on a printed circuit board (PCB).

The PCB may be located at a center of a recessed portion 125 that is surrounded by the vertical wall 121. A sealer groove 124 may be formed at a bottom of the recessed portion 125 so as to surround the PCB. The sealer 134 may be provided in the sealer groove 124.

The window 131 may be provided on the base 120 to cover the light source 130 (or light member). The window 131 may include a plurality of light concentration portions corresponding to the respective LEDs. The window 131 may be attached, such as by screws, to a bottom of the recessed portion 125 outside of the sealer 134. The window 131 may be in tight contact with the sealer 134. For the attaching or fixing, fixing holes 127*a*, 127*b*, 127*c*, and 127*d* may be provided to the recessed portion 125. That is, the sealer 134 (or sealant) may be provided between the fixing holes 127*a*, 127*b*, 127*c* and 127*d*.

The cover 132 may cover a circumferential surface of the window 131.

The housing 100 may be made of a metal material having good heat-dissipation properties. The housing 100 may function as a heat sink to effectively dissipate heat generated by the light source 130 to outside the lighting device. The housing 100 may be made of aluminum.

A pair of sitting portions 123*a* and 123*b* may be provided on the base 120. The sitting portions 123*a* and 123*b* may be provided on and supported by a frame that is for holding a plurality of light modules, such as the lighting device of FIG. 1. The sitting portions 123*a* and 123*b* may be positioned opposite to each other such that the light source 130 is provided between the sitting portions 123*a* and 123*b*.

The vertical wall 121 may prevent the window 131 and the light source 130 from being damaged by the frame when the lighting device is seated on the frame.

A channel 126 communicating with the outside may be formed through a bottom of the recessed portion 125. The light source 130 may be electrically connected with an external power supply through the channel 126.

Although FIG. 1 shows the recessed portion 125 located at an inside of the vertical wall 121 that vertically protrudes from one surface of the housing 100, the recessed portion 125 may be formed without the vertical wall 121. That is, the recessed portion 125 may be formed on one surface of the housing without the vertical wall 121, and the light source 130 may be provided on the recessed portion 125.

Figure 2:
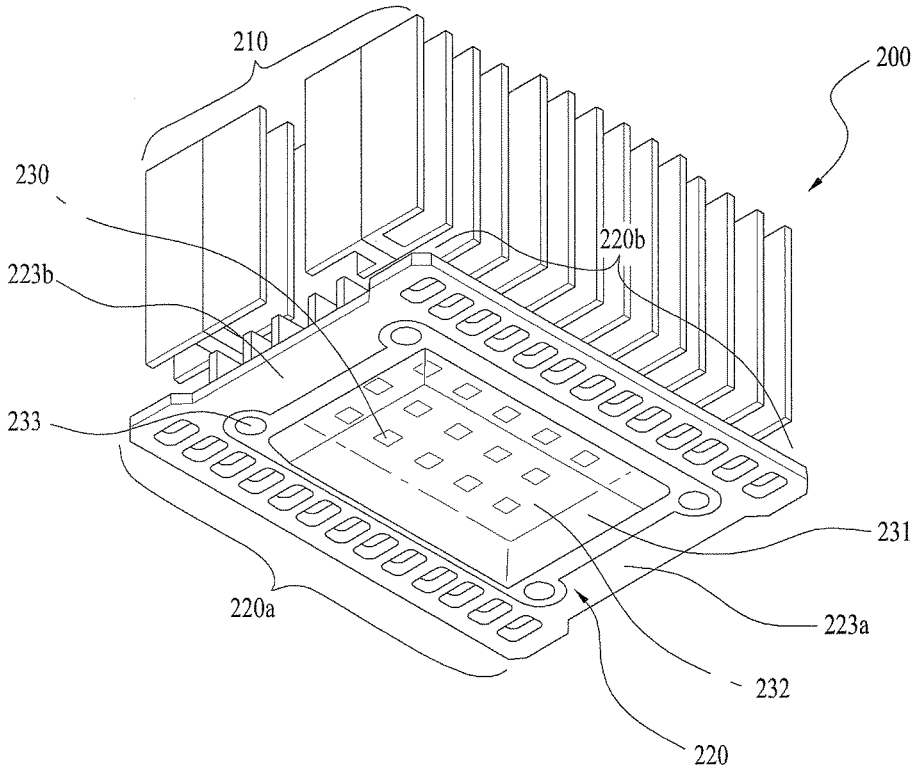
FIGS. 2 and 3 are views of a lighting device in accordance with an example embodiment.
Figure 3:
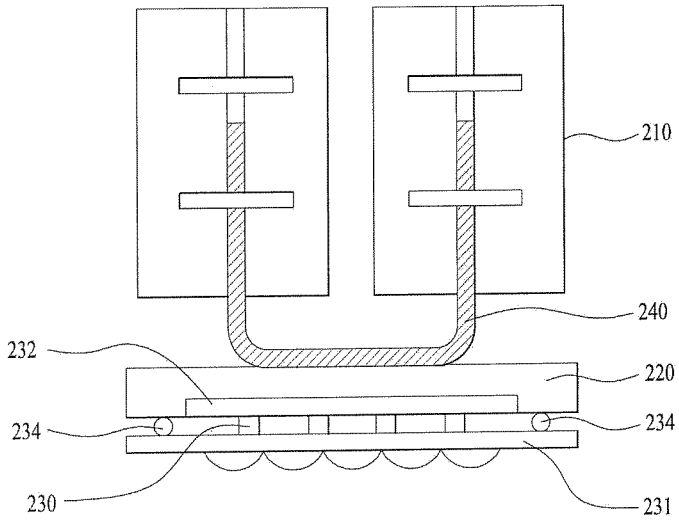

FIGS. 2 and 3 are views of a lighting device in accordance with an example embodiment. Other embodiments and configurations may also be provided.

FIGS. 2-3 show that a housing 200 may include a plurality of cooling fins 210, a base 220, a light source 230 (or light member), and a heat pipe 240. Although the lighting device in FIG. 1 includes the housing 200 formed in one piece, the lighting device of FIGS. 2 and 3 includes the housing 200 as a plurality of pieces.

The base 220 may be similar to the base 120. A recessed portion may be provided on a lower surface (or first side) of the base 220. The light source 230 (or light member) on a printed circuit board (PCB) 232 may be provided in the recessed portion. A sealer 234 (or sealant) may be provided outside of the PCB 232, and a window 231 may be provided on the base 220 with a tight contact with the sealer 234. The window 231 may be fixed or attached by screws 233 to the recessed portion at outside of the sealer 234.

A plurality of holes may be formed at both sides (i.e., the first and second sides) of the recessed portion of the base 220.

The housing 200 (or heat sink) may have the plurality of cooling fins 210 and may be provided above the base 220. The cooling fins 210 may be separated from the base 220 such that an open space is provided between the cooling fins 210 and the base 220. Air passages may be provided between the cooling fins 210. The air passages may be open at tops of the cooling fins 210 (or above the cooling fins 210) and bottoms of the cooling fins 210 (or below the cooling fins 210). Therefore, horizontal air flow and vertical air flow may be established through the air passages.

The holes of the base 220 may be arranged in between the cooling fins 210, thereby facilitating the air flow.

The heat pipe 240 may be provided between the base 220 and the cooling fins 210. The heat pipe 240 may have a U shape in which both leg portions are connected to the cooling fins 210 and an intermediate connection portion connecting both leg portions and that contacts the base 220.

The base 220 and the cooling fins 210 may be made of metal materials having good heat conductivity. For example, both the base 220 and the cooling fins 210 may be made of aluminum. The base 220 and the cooling fins 210 may also be made of different materials.

In at least one embodiment, the base 220 and the cooling fins 210 may directly contact each other without the heat pipe 240. Further, the heat pipe 240 may be provided in a flat shape such that the base 220 and the cooling fins 210 contact both surfaces of the heat pipe 240, respectively.

The base 220 and the cooling fins 210 may be integrally formed as one integral piece. The cooling fins 210 may be partially spaced from the base 220 such that air flowing between the cooling fins 210 may flow out through the open space between the cooling fins 210 and the base 220. This air flow may establish vertical air flow. Air may also flow horizontally between the cooling fins 210.

Air passages between the cooling fins 210 may be open at tops of the cooling fins 210 and bottoms of the cooling fins 210 so as to establish air flow in the vertical direction (such as along the axis 10) as well as in the horizontal direction (such as along the axis 20).

A plurality of through-holes may be formed through a surface of the housing 200 on which the light source is mounted. Thereby, air flow may be established around the light source. That is, the plurality of through-holes may be formed through the surface of the housing 200 on which the light source is located.

Additional cooling fins may be provided on a top surface of the base 220 in an area between the base 220 and the cooling fins 210. The additional cooling fins on the top surface of the base 220 may be aligned in a direction different than the alignment direction of the cooling fins 210.

Figure 4:
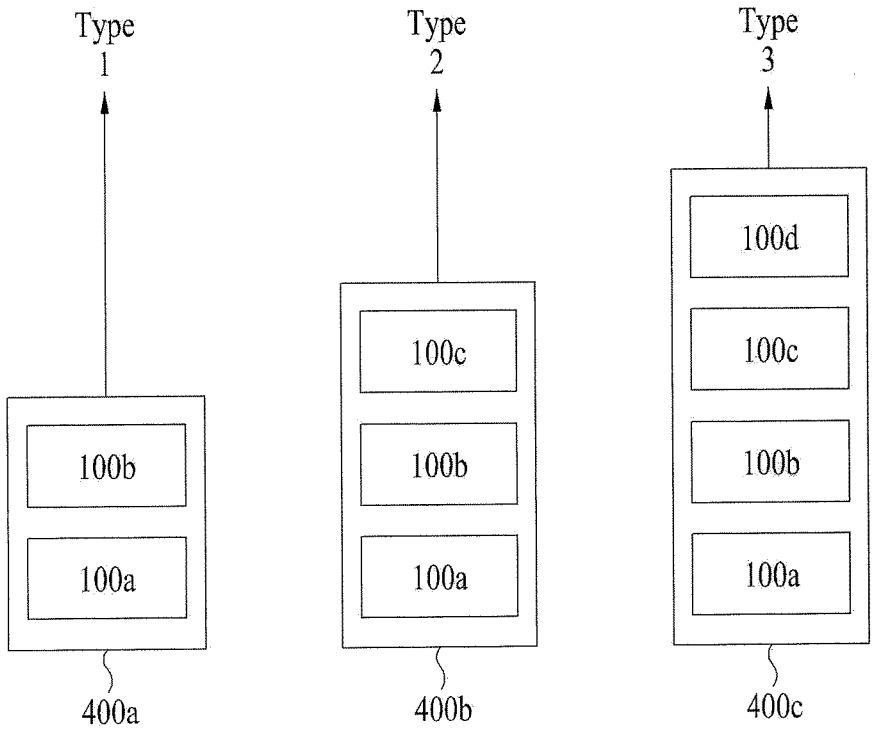
FIG. 4 illustrates configurations of a module type lighting device in accordance with example embodiments.

FIG. 4 illustrates configurations of a module type lighting device in accordance with example embodiments. Other embodiments and configurations may also be provided.

As shown in FIG. 4, the module type lighting device may include a plurality of light modules 100*a*, 100*b*, 100*c*, and 100*d*. The above described lighting devices of FIG. 1 or 2 may be used for each of the light modules 100*a*, 100*b*, 100*c*, and 100*d*. The plurality of light modules 100*a*, 100*b*, 100*c*, and 100*d* may be provided within one of a plurality of frames 400*a*, 400*b*, or 400*c*. That is, FIG. 4 shows configurations of the module type lighting device in which two, three, and four light modules may be assembled with the frames 400*a*, 400*b*, or 400*c*, respectively.

Such a module type lighting device may use respective light modules having a same structure, and it may be modified in various ways by changing a size of the frames 400*a*, 400*b*, or 400*c*.

Figure 5:
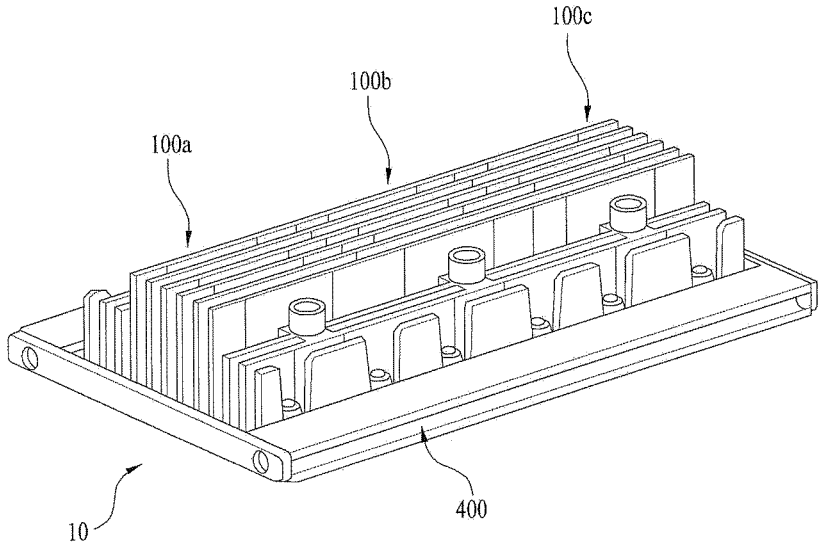
FIG. 5 illustrates a rear surface of the module type lighting device of FIG. 4.
Figure 6:
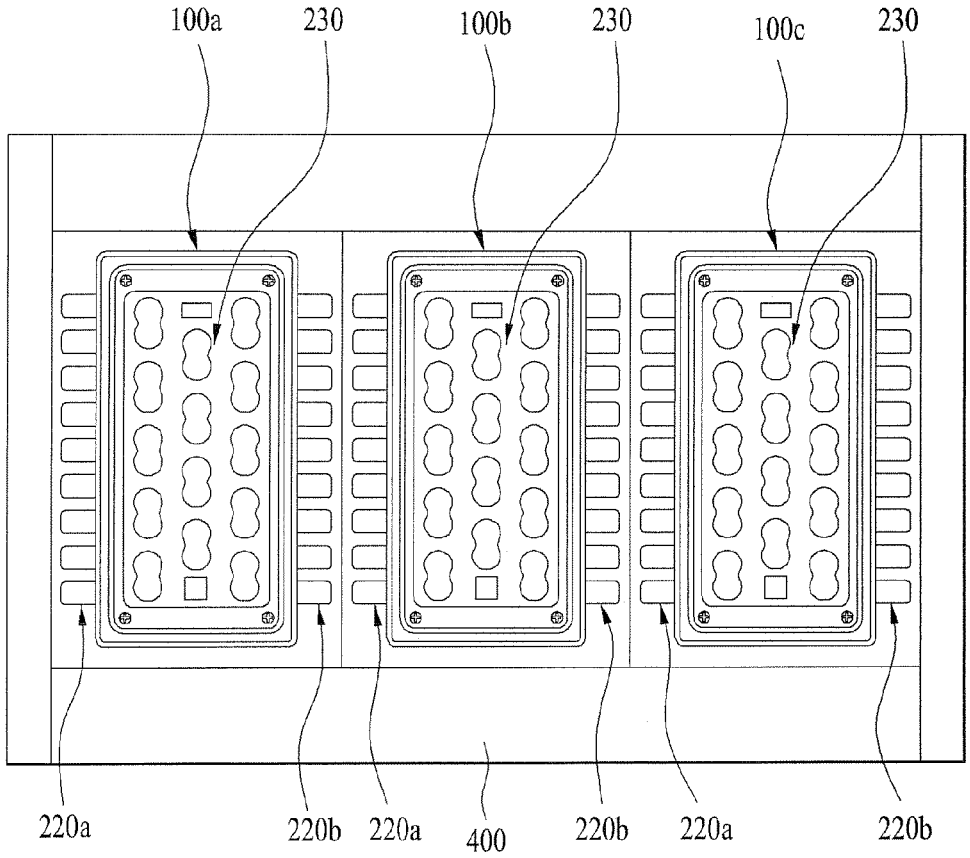
FIG. 6 is a front view of the module type lighting device of FIG. 4.
Figure 7:
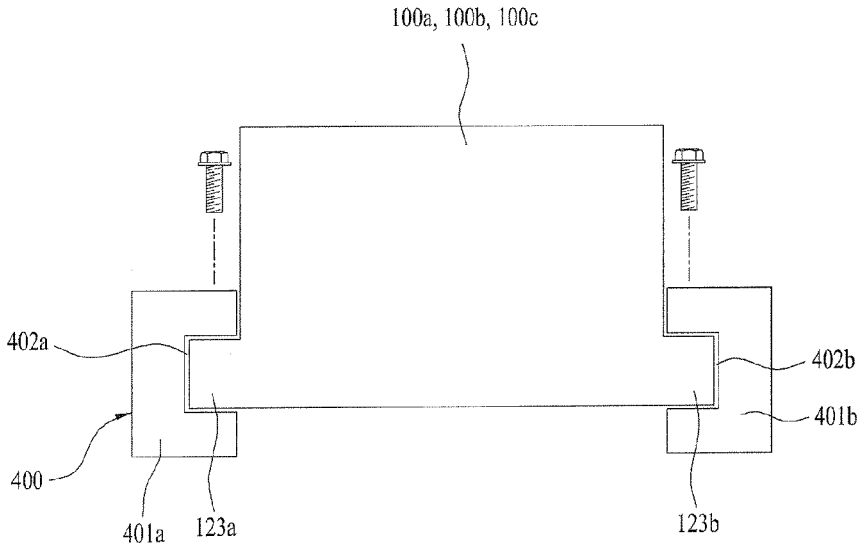
FIG. 7 is a view illustrating insertion of a light module into C-shaped sliding guides.
Figure 8:
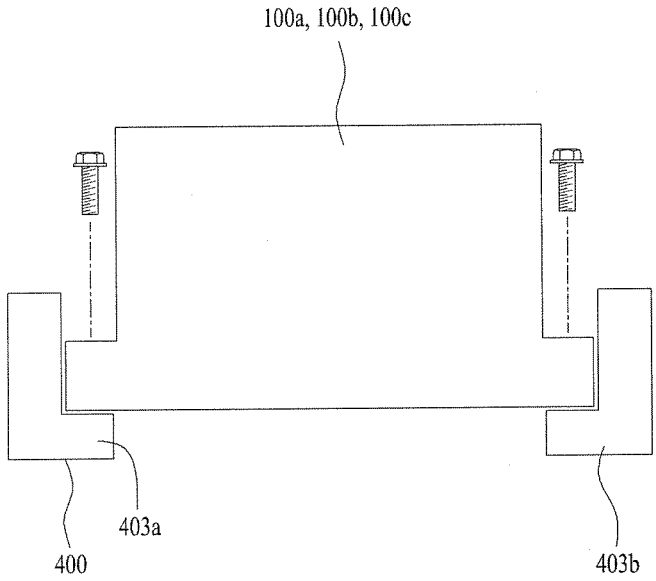
FIG. 8 is a view illustrating insertion of a light module into L-shaped sliding guides.
Figure 9:
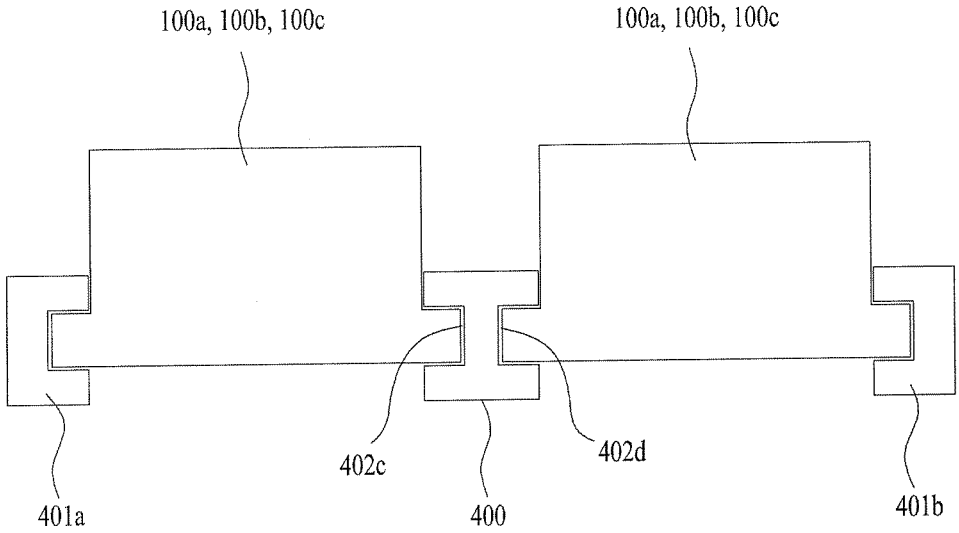
FIG. 9 is a view illustrating mounting of light modules on a frame in accordance with an example embodiment.

FIG. 5 illustrates a rear surface of the module type lighting device using three light modules 100*a*, 100*b*, and 100*c*. FIG. 6 illustrates a front surface of the module type lighting device of FIG. 5. FIGS. 7, 8 and 9 illustrates various embodiments of assembly of the light modules 100*a*-100*c* with the frame 400. Other embodiments and configurations may also be provided.

The frame 400 may include a pair of sliding guides 401*a* and 401*b*. A pair of sitting portions 123*a* and 123*b* of the lighting device of FIG. 1 or 2 may be seated on and supported by the pair of sliding guides 401*a* and 401*b*.

The frame 400 may have an approximately rectangular shape, and may include the sliding guides 401*a* and 401*b* provided in the longitudinal direction.

The sliding guides 401*a* or 401*b* may include a groove 402*a* or 402*b* provided along the longitudinal direction. The sitting portions 123*a* and 123*b* may be inserted into the grooves 402*a* and 402*b* of the sliding guides 401*a* and 401*b* in a sliding manner.

The light modules 100*a*, 100*b*, and 100*c* may be fixed or attached to the frame 400, such as by screws. For example, bosses having female screws may be further formed on the rear surface of the housing of the lighting device of FIG. 1 or 2 (i.e., the surface of the housing opposite to the surface on which the light source is located). The frame 400 may be provided with holes at positions corresponding to the bosses so as to pass the screws. Therefore, the light modules 100*a*, 100*b*, and 100*c* may be fixed or attached to the frame 400 by fastening the screws to the bosses via the holes.

Such a lighting device as shown in FIG. 6 may have through-holes 220*a* and 220*b* between the respective light sources. That is, the lighting device of FIG. 6 may be like having a housing provided with a plurality of through-holes 220*a* and 220*b* between light sources 230.

Such a housing may be provided with the through-holes 220*a* and 220*b* around the light sources 230 or the through-holes 220*a* and 220*b* between the light sources 230 may be applied to lighting devices other than a module type lighting device.

FIG. 7 illustrates the module type lighting device of FIGS. 5 and 6. The frame 400 of FIG. 5 includes a pair of sliding guides 401*a* and 401*b*, each of which includes a C-shaped groove 402*a* or 402*b*. The sitting portions 123*a* and 123*b* (or 223*a* and 223*b*) are inserted into the grooves 402*a* and 402*b* of the sliding guides 401*a* and 401*b*, thereby enabling the light modules 100*a*-100*b* to be assembled with the frame 400 in a sliding manner.

FIG. 8 illustrates an example embodiment in which a pair of sliding guides 403*a* and 403*b* having an L-shaped cross-section is provided. The sitting portions 123*a* and 123*b* (or 223*a* and 223*b*) are seated on the L-shaped sliding guides 403*a* and 403*b*. In this example, the light modules 100*a*-100*c* may be slidably provided on the frame 400 in the vertical direction as well as in the longitudinal direction. Therefore, if the light module 100*b* located at a center is replaced with a new one, only the light module 100*b* may need to be detached from the frame 400 without detachment of the adjacent light modules 100*a* and 100*c* from the frame 400.

FIG. 9 illustrates another example embodiment in which the light modules 100*a*-100*c* are arranged in two lines rather than one line. The three light modules 100*a*-100*c* are arranged in each of two lines. In this example, the frame 400 includes an intermediate sliding guide 401*c* in addition to a pair of the sliding guides 401*a* and 401*b*. As shown in FIG. 9, one array of the light modules 100*a*-100*c* is arranged between the sliding guide 401*a* and the intermediate sliding guide 401*c*, and another array of the light modules 100*a*-100*c* is arranged between the other sliding guide 401*b* and the intermediate sliding guide 401*c*. The intermediate sliding guide 401*c* includes grooves 402*c* and 402*d* at both sides thereof. In FIG. 9, the intermediate sliding guide 401*c* has an I-shaped cross-section.

Figure 10:
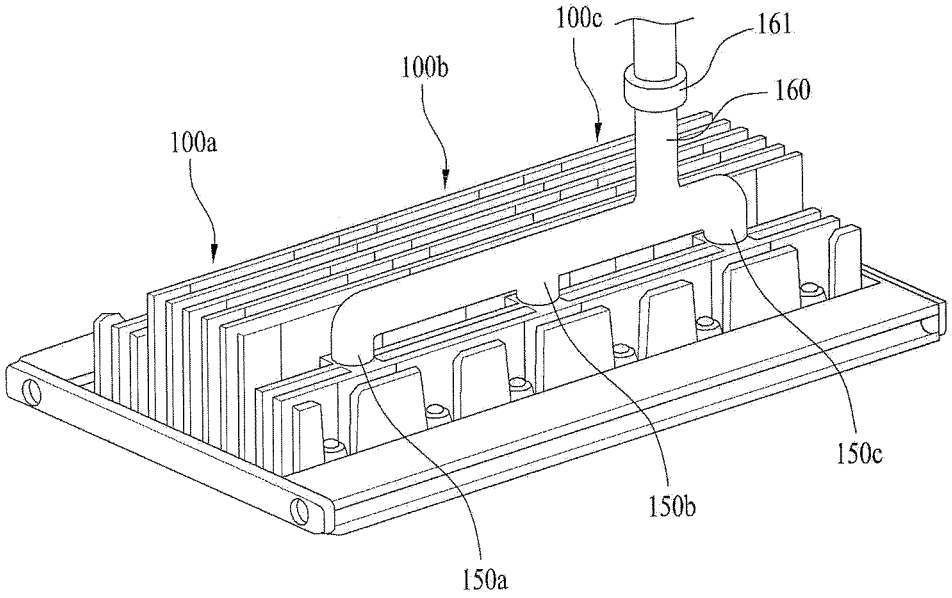
FIG. 10 is a view illustrating a lighting device provided with a HEPA filter.

Moisture of air inside the window 131 (or 231) may be condensed and may cause an undesirable problem. FIG. 10 shows one way to solve the problem.

As shown in FIG. 10, a channel 150*a*, 150*b*, 150*c*, and 160 may be provided to communicate an inside of the window 231 with the outside. The air inside the window 131 (or 231) may be discharged to the outside via the channel 150*a*, 150*b*, 150*c*, and 160. A filter 161 may be provided in the channel 150*a*, 150*b*, 150*c*, and 160 so as to prevent foreign substances from being introduced inside the window 131 (or 231). The filter 161 may be a HEPA filter, for example. When the lighting device is used as an outside lighting device, such as a streetlight, the inside of the window 131 (or 231) may be filled with moisture due to rain or snow. The FIG. 10 structure may prevent such a problem.

FIG. 10 illustrates the module type lighting device. As shown in FIG. 10, the plurality of light modules 100*a*, 100*b*, and 100*c* respectively include the channels 150*a*, 150*b*, and 150*c* to communicate the inside and the outside of the window 131 or 231 with each other, and the channels 150*a*, 150*b*, and 150*c* are connected by one connection pipe 160, and a HEPA filter 161 may be provided on the connection pipe 160.

A lighting device having a good heat-dissipation performance, and more particularly, a high power LED lighting device that effectively dissipates a large amount of heat generated by LEDs may be desirable because lifespan and illumination performance of the lighting device may be improved.

A module type lighting device having a plurality of light modules assembled with one frame may be desirable since intensity of illumination may be easily changed by changing a size of the frame and a number of the light modules.

The lighting device may include air passages to allow air to flow through to cool the heat. The air passages may include air passages in a light emitting direction of the lighting device and air passages in a direction transverse to the light emitting direction. The light emitting direction may be a vertical direction (such as along the axis 10) and the transverse direction may be a horizontal direction (such as along the axis 20) when the lighting device is provided as shown in FIG. 1. That is, when the lighting device is installed so as to illuminate downwards, the light emitting direction may be the vertical direction (such as along the axis 10). The lighting device may hereafter be described as being to illuminate downwards. However, embodiments of the present invention are not limited to direction of the installation.

The air passages may communicate directly with an outside to allow in external air. The air passages in the horizontal direction and the air passages in the vertical direction may communicate with each other. An air flow may be further facilitated.

The lighting device may include a light source (such as an LED), and a housing to which the light source is attached.

The housing may include a heat sink. The housing may further include the above-described air passages.

The housing (or the heat sink) may include a plurality of cooling fins. The light source may be located on an opposite side of the housing as compared to the cooling fins. The air passages in the horizontal direction may include passages between the cooling fins. The air passages formed in the vertical direction may include through-holes formed through the housing in the vertical direction. The through-holes may be arranged between the cooling fins so that the air passages in the two directions are in flow communication with each other. The cooling fins may be formed in various shapes. For example, the cooling fins may be formed in a column shape or in a flat shape.

The cooling fins may be exposed to outside of the lighting device. Thereby, the cooling fins may directly contact external air.

Parts of side surfaces of the through-holes may be opened. That is, for example, the through-holes may be C-shaped. As long as the through-holes provide air passage in the vertical direction, a shape of the through-holes is not limited thereto.

The housing may be formed in one piece, or may be formed by connecting a plurality of pieces. For example, air passages in the horizontal and vertical directions may be formed in a one-piece housing, or may be formed in several pieces that form the housing.

The air passages in the vertical direction may establish air communication between spaces above and below the lighting device. Upper and lower spaces with respect to a virtual horizontal plane on which the light source is located may be in flow communication with each other.

In an embodiment, air passages in the vertical direction may be provided at a portion above the light source. One example of this embodiment is that air passages established between cooling fins may be open at top and bottom. The passages may also be open at both sides to establish the air passages in the horizontal direction. In this example, air may flow between the cooling fins in the vertical direction as well as in the horizontal direction above the light source.

The housing may include a vertical wall that vertically protrudes so as to surround the light source. A plurality of through-holes may be provided around the wall at the opposite side of the light source.

The housing may include a pair of sitting portions that are to be seated on and supported by a frame. The pair of sitting portions may be located opposite to each other with respect to the light source.

The housing may include a recessed portion in which the light source is located. The recessed portion may be deep enough such that the light source can be fully inserted therein without protruding over the recessed portion. The recessed portion may have a depth to completely insert even a window (or lens) covering the light source.

The light source may include one or a plurality of LEDs. The LEDs may be mounted (or provided) on a printed circuit board (PCB), and the PCB may be located at a center of the recessed portion of the housing. The PCB may be a metal PCB.

The lighting device may further include a flat heat pipe in the recessed portion, and the PCB may be provided on the heat pipe. The heat pipe may provide a rapid transfer of heat from the light source to the heat sink.

A groove surrounding the PCB may be formed in the recessed portion. A sealer may be provided in the groove. A window for covering the light source may be attached with a tight contact with the sealer. The window may be attached to the recessed portion at its both ends such that the sealer is located between the attached both ends.

In order to raise heat dissipation performance of the lighting device, the housing may include the heat pipe. The heat pipe may be provided to transfer heat from the light source to the heat sink having the cooling fins. The heat pipe may have a U shape in which both leg portions are connected to the heat sink and an intermediate connection portion connecting both leg portions is located at the side of the lighting device provided with the light source so as to receive light from the light source. Alternatively, the heat pipe may have a flat shape. In this example, one surface of the heat pipe may contact the PCB, and the other surface of the heat pipe may contact the heat sink.

The lighting device may have a plurality of light sources, and the plurality of light sources may be arranged such that a direction of a longitudinal axis of an arrangement of the light sources is transverse to a longitudinal direction of the cooling fins. For example, the cooling fins may be formed in a direction transverse to a direction of a longitudinal axis of an approximately rectangular arrangement of the light sources.

A module type lighting device may include a plurality of light modules. Each of the light modules may correspond to the above-described lighting device. That is, the module type lighting device may include a plurality of light modules, each having air passages of the horizontal and vertical directions. All of the light modules may be fixed or attached to one frame.

A direction of a longitudinal axis of an arrangement of the light sources of the module type lighting device may coincide with a longitudinal direction of the cooling fins.

Air passages of the vertical direction may be provided between the light sources. These air passages are not necessarily limited to the module type lighting device.

The module type lighting device may vary in size. The variety may be achieved by changing a size of the frame and a number of the light modules. In order to achieve easiness in assembling and replacing, the light modules may be inserted into the frame in a sliding manner.

The module type lighting device may be used as a streetlight.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

a light member having a light emitting diode (LED) to emit light in a first direction along a first axis; and a housing having a base to support the light member on a first side of the base, and the housing having a plurality of cooling fins that extend in a second direction away from a second side of the base, the base including a plurality of holes to provide an air flow in the second direction away from the second side, wherein each hole extends through the housing from the first side of the base to the second side of the base, and wherein each hole corresponds to an open area between two separate ones of the cooling fins, wherein a first air flow passage is provided along the first axis from the cooling fins, and a second air flow passage is provided along a second axis from in between different ones of the cooling fins.

2. The lighting device of claim 1, wherein the first air flow passage is provided in a vertical direction from the cooling fins, and the second air flow passage is provided in a horizontal direction from in between different ones of the cooling fins.

3. The lighting device of claim 1, wherein the housing includes a heat pipe provided at least between the base and the plurality of cooling fins.

4. The lighting device of claim 1, wherein an open space is provided between the base and the plurality of cooling fins.

5. The lighting device of claim 1, wherein the plurality of cooling fins are arranged to each extend in the first direction.

6. A lighting device comprising:

a light member having a light emitting diode (LED);

a housing having a base to support the light member on a first side of the base, and having a plurality of cooling fins on a second side of the base; and a heat pipe provided at least between the base and the plurality of cooling fins, wherein the base includes a plurality of holes to provide an air flow from the first side of the base to the second side of the base, and wherein a first air flow passage is provided along a first axis from the cooling fins, and a second air flow passage is provided along a second axis from in between different ones of the cooling fins.

7. The lighting device of claim 6, wherein the heat pipe contacts the second side of the base.

8. The lighting device of claim 6, wherein the plurality of cooling fins are arranged to each extend in a first direction.

9. The lighting device of claim 8, wherein an open space is provided between the plurality of cooling fins and the second side of the base.

10. The lighting device of claim 6, wherein the first air flow passage is provided in a vertical direction from the cooling fins, and the second air flow passage is provided in a horizontal direction from in between different ones of the cooling fins.

11. A lighting device comprising:

a plurality of light modules each having a light emitting diode (LED) on a first side of a base to emit light, and a plurality of cooling fins on a second side of the base; and a frame to support the plurality of light modules, wherein the base includes a plurality of holes to provide an air flow from the first side of the base to the second side of the base, wherein a first air flow passage is provided along a first axis from the cooling fins, and a second air flow passage is provided along a second axis from in between different ones of the cooling fins.

12. The lighting device of claim 11, wherein the light module further includes a heat pipe provided at least between the base and the plurality of cooling fins.

13. The lighting device of claim 12, wherein the heat pipe contacts the second side of the base.

14. The lighting device of claim 11, wherein an open space is provided between the base and the plurality of cooling fins.

* * * * *